US011143456B2

(12) United States Patent
Cen et al.

(10) Patent No.: US 11,143,456 B2
(45) Date of Patent: Oct. 12, 2021

(54) HEAT EXCHANGER

(71) Applicants: KEYON PROCESS CO., LTD, Shanghai (CN); RUI HUANG, Shanghai (CN)

(72) Inventors: Long Cen, Shanghai (CN); Binbin Fei, Shanghai (CN); Xiaojian Wang, Shanghai (CN); Hao Wang, Shanghai (CN); Qiang Ma, Shanghai (CN)

(73) Assignees: KEYON PROCESS CO., LTD, Shanghai (CN); RUI HUANG, Shanghai (CN)

( * ) Notice: Subject to any disclaimer, the term of this patent is extended or adjusted under 35 U.S.C. 154(b) by 419 days.

(21) Appl. No.: 16/321,692

(22) PCT Filed: Jul. 25, 2017

(86) PCT No.: PCT/CN2017/094225
§ 371 (c)(1),
(2) Date: Jan. 29, 2019

(87) PCT Pub. No.: WO2018/019218
PCT Pub. Date: Feb. 1, 2018

(65) Prior Publication Data

US 2021/0285726 A1 Sep. 16, 2021

(30) Foreign Application Priority Data

Jul. 29, 2016 (CN) ..... 201610613583.4
Jul. 29, 2016 (CN) ..... 201620815428.6

(51) Int. Cl.
*F28D 7/10* (2006.01)
*F28F 1/40* (2006.01)
(Continued)

(52) U.S. Cl.
CPC ..... *F28D 7/10* (2013.01); *F28F 1/40* (2013.01); *F28F 9/22* (2013.01); *F28F 17/005* (2013.01); *F28F 2009/226* (2013.01)

(58) Field of Classification Search
CPC ..... F28D 7/10; F28F 1/40; F28F 9/22; F28F 17/005; F28F 2009/226
(Continued)

(56) References Cited

U.S. PATENT DOCUMENTS 4,342,362 A * 8/1982 Belleli ..... F22B 1/063 122/32
4,348,354 A * 9/1982 Artaud ..... G21C 1/03 376/405
(Continued)

FOREIGN PATENT DOCUMENTS

CN 2864559 1/2007
CN 101256043 A 9/2008
(Continued)

OTHER PUBLICATIONS

First Office Action and Search Report issued in the Chinese priority application No. 201610613583.4 dated Nov. 28, 2017.
(Continued)

*Primary Examiner* — Davis D Hwu
(74) *Attorney, Agent, or Firm* — Christopher M. Scherer; DeWitt LLP

(57) ABSTRACT

A heat exchanger, comprising: a top cover (2) which is provided with a top cavity (21); a liquid-collecting chamber (1) which is provided with a liquid-collecting cavity (11); a housing (3) which is provided with a receiving cavity (31), neither of the liquid-collecting cavity (11) nor the top cavity (21) being in connection with the receiving cavity (31); an upper tube plate (4); a lower tube plate (5); and a heat exchange tube (6) which sequentially passes through the top
(Continued)

cavity (21), the upper tube plate (4), the receiving cavity (31), the lower tube plate (5), and the liquid-collecting cavity (11); the two ends of the heat exchange tube (6) are in connection with the liquid-collecting cavity (11) and the top cavity (21), respectively; sealing members (8) are provided between the outer circumference of the heat exchange tube (6) and the upper tube plate (4) and between the outer circumference of the heat exchange tube (6) and the lower tube plate (5). By means of the three-section structure consisting of the liquid-collecting chamber (1), the top cover (2), and the housing (3), and the structure of the heat exchange tube (6) respectively passing through the upper tube plate (4) and the lower tube plate (5) in a dismountable manner, the heat exchanger is easy to mount and dismount, easing the maintenance and cleaning of the heat exchanger; the heat exchanger can be used, in particular, in the heat exchange of a strongly corrosive medium under a high temperature, and has a compact structure and high heat exchange efficiency.

10 Claims, 3 Drawing Sheets

(51) Int. Cl.
*F28F 9/22* (2006.01)
*F28F 17/00* (2006.01)

(58) Field of Classification Search
USPC ..... 165/154
See application file for complete search history.

(56) References Cited

U.S. PATENT DOCUMENTS

| | | | | |
|---|---|---|---|---|
| 4,842,055 | A * | 6/1989 | Ohtsu | B01D 1/06 122/406.3 |
| 4,925,526 | A * | 5/1990 | Havukainen | B01D 1/065 159/13.3 |
| 2012/0199330 | A1 | 8/2012 | Maurer | |

FOREIGN PATENT DOCUMENTS

| | | |
|---|---|---|
| CN | 202511683 | 10/2012 |
| CN | 203928811 | 11/2014 |
| CN | 205352115 | 6/2016 |
| CN | 106288874 A | 1/2017 |
| CN | 206073768 | 4/2017 |

OTHER PUBLICATIONS

Second Office Action issued in the Chinese priority application No. 201610613583.4 dated Jul. 23, 2018.
Third Office Action issued in the Chinese priority application No. 201610613583.4 dated Jan. 22, 2019.
Notification to Grant Patent Right for Invention issued in the Chinese priority application No. 201610613583.4 dated Mar. 25, 2019.
International Search Report and Written Opinion of PCT/CN2017/094225 dated Oct. 31, 2017.

* cited by examiner

HEAT EXCHANGER

CROSS-REFERENCE TO RELATED APPLICATIONS

The present application is the U.S. national stage application of International Application No. PCT/CN2017/094225, filed Jul. 25, 2017, which international application was published on Feb. 2, 2018, as international Publication No. WO2018/019218. The International Application claims priority of Chinese patent application CN201610613583.4 and CN201620815428.6 filed on Jul. 29, 2016, the contents of which are incorporated herein by reference their entireties.

FIELD OF INVENTION

The present invention relates to a heat exchanger.

PRIOR ARTS

In the prior art, strongly corrosive medium under a high temperature, in which conventional metal heat exchange equipment is difficult to work for a long time. Instead, non-metallic materials such as ceramics or PTFE or glass are normally adopted for high temperature corrosive service. In most cases, glass heat exchange tubes within heat exchange equipment are filled with flowing strongly corrosive steam under a high temperature, with cold air as coolant which has contact with external walls of the glass tubes, so that hot and strongly corrosive steam condenses into liquid by cooling effect, and the glass tubes are integrally formed with upper and lower end caps of the exchanger chamber. The whole integrated part is connected with the chamber housing at the upper and lower end caps, which makes it difficult to clean, maintain or replace exchanger tubes.

CONTENT OF THE PRESENT INVENTION

The technical problem to be solved by the present invention is to overcome the defects in the prior art that are inconvenient to maintain, maintain and clean, caused by the integrally formed heat exchanger, and provides a heat exchanger.

The present invention solves the above technical problems by the following technical solutions:

A heat exchanger, wherein it comprises:

a liquid-collecting chamber, the liquid-collecting chamber is provided with a liquid-collecting cavity and a strongly corrosive medium inlet;

a top cover, the top cover is provided with a top cavity and a strongly corrosive medium outlet;

a housing, the housing is detachably connected between the liquid-collecting chamber and the top cover, and the housing is provided with a receiving cavity, neither the liquid-collecting cavity nor the top cavity are in communication with the receiving cavity, and a heat exchange medium inlet and a heat exchange medium outlet are spaced apart on sidewall of the housing;

an upper tube plate, the upper tube plate is connected to one end of the housing, and is located between the housing and the top cover, the upper tube plate partitions the receiving cavity from the top cavity;

a lower tube plate, the lower tube plate is connected to the other end of the housing, and is located between the housing and the liquid-collecting chamber, the lower tube plate partitions the receiving cavity from the liquid-collecting chamber;

a heat exchange tube, the heat exchange tube sequentially passes through the top cavity, the upper tube plate, the receiving cavity, the lower tube plate and the liquid-collecting cavity, two ends of the heat exchange tube in communication with the liquid-collecting cavity and the top cavity respectively, sealing members are clamped between the outer circumference of the heat exchange tube and the upper tube plate and between the outer circumference of the heat exchange tube and the lower tube plate. As the heat exchange tube is connected to the upper tube plate and the lower tube plate with sealing, the strongly corrosive medium under a high temperature does not affect components within the receiving cavity of the housing.

Preferably, outer surfaces of the upper tube plate and the lower tube plate, inner wall surfaces of the top cover and the liquid-collecting chamber are covered with corrosion resistant layer, and the material of the corrosion resistant layer is fluoropolymer. The corrosion resistant layer is used to prevent the strongly corrosive medium under a high temperature from damaging the outer surfaces of the upper tube plate and the lower tube plate, or the inner wall surfaces of the top cover and the liquid-collecting chamber.

Preferably, the heat exchanger is further provided with a down tube, one end of the down tube abuts against the upper tube plate, the other end of the down tube passes through the lower tube plate, sealing members are clamped between an outer circumference of the down tube and the upper tube plate and between the outer circumference of the down tube and the lower tube plate, and two ends of the down tube connect respectively to the top cavity and the liquid-collecting cavity with sealing. The down tube sealingly connects respectively to the upper tube plate and the lower tube plate through sealing members, so that strongly corrosive medium under a high temperature does not affect the components within the receiving cavity of the housing.

Preferably, the heat exchanger comprises a supporting plate, the supporting plate is located in the receiving cavity, and a part of outer circumference of the supporting plate abuts against an inner wall of the housing, a gap is formed between the other part of the outer circumference of the supporting plate and the inner wall of the housing, and both the heat exchange tube and the down tube pass through the supporting plate.

Preferably, buffer rings are clipped between the outer circumference of the heat exchange tube and the supporting plate and between the outer circumference of the down tube and the supporting plate, and materials of the buffer rings are rubber. The buffer rings have a function of buffering and protecting the heat exchange tube and the down tube.

Preferably, a gas-liquid separator is set up at the end of the heat exchange tube which is more distant from the liquid-collecting cavity; rotating piece is put inside heat exchange tube.

Preferably, a drainage groove is provided on one side of the upper tube plate facing the top cavity, and the drainage groove is in communication with the down tube.

Preferably, a condensate outlet is set up at the end of the liquid-collecting chamber which is more distant from the housing.

Preferably, manhole is set upon the sidewall of the housing, and the manhole is used to observe and maintain the receiving cavity.

Preferably, the inner wall of the housing is covered with an insulation layer.

The advantages of the invention are listed below:

1. The invention is meant to ease installation and disassembly of the equipment as well as to lessen the workload of equipment maintenance and cleaning, thanks to a three-section structure consisting of the liquid-collecting chamber, the top cover, and the housing, as well as a structure that the detachable heat exchange tubes respectively pass through the upper tube plate and the lower tube plate;

2. The heat exchanger of the invention can be especially used for heat exchange of strongly corrosive medium under a high temperature, and has a compact structure with high efficiency of heat exchange;

3. The invention enhances heat transfer efficiency by setting rotating piece in the heat exchange tube, and the strongly corrosive medium under a high temperature passes through an inner cavity of the heat exchange tube bottom-up, constantly impacting the rotating piece and forming a swirl while passing through the rotating piece;

4. The invention makes the heat exchange tubes be sealingly connected to the upper tube plate and the lower tube plate respectively and the down tube be sealingly connected to the upper tube plate and the lower tube plate respectively, through sealing member, so that the strongly corrosive medium under a high temperature does not affect the components in the receiving cavity of the housing;

5. The invention is used for preventing the strongly corrosive medium from damaging the outer surfaces of the upper tube plate and the lower tube plate, the inner wall surfaces of the top cover and the liquid-collecting chamber by the corrosion resistant layer;

6. The heat exchanger of the invention can be designed as a set of parallel or series structures according to actual needs, so to reduce production cost and production period.

Figure 1:
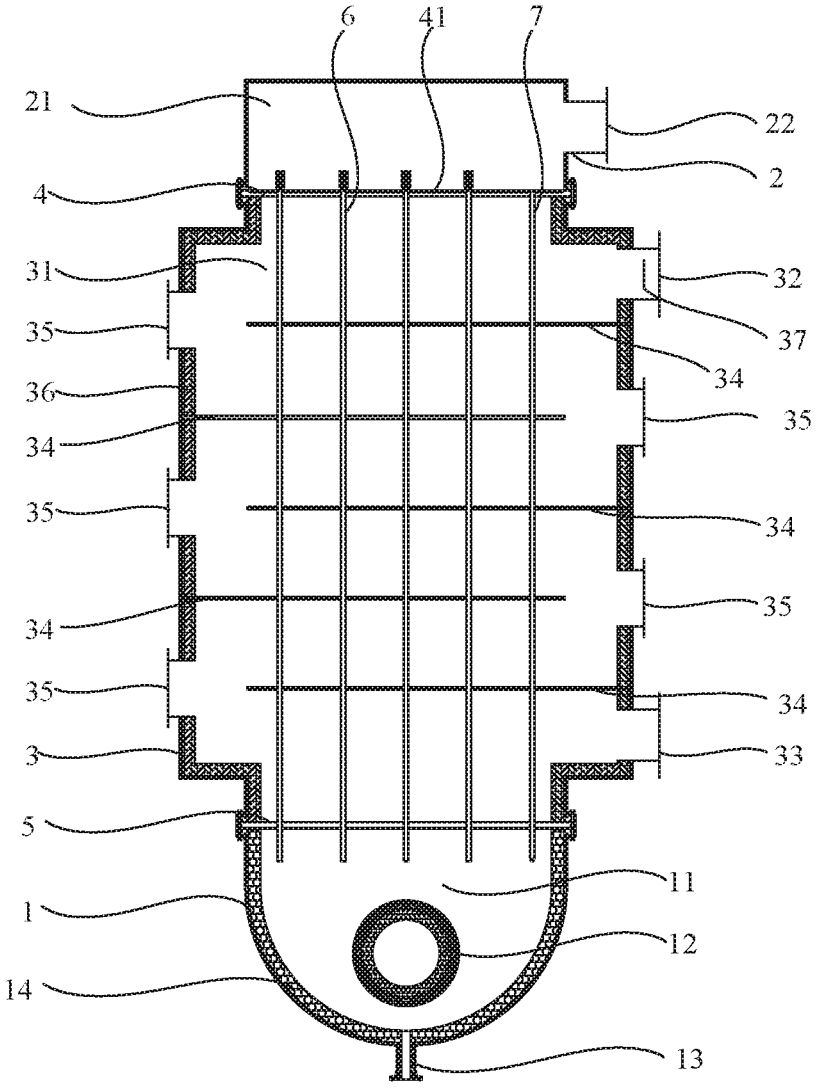
FIG. 1 is an inner structure schematic view of a heat exchanger according to a preferred embodiment of the present invention.

DESCRIPTION OF REFERENCES NUMERALS liquid-collecting chamber 1
liquid-collecting cavity 11
strongly corrosive medium inlet 12
condensate outlet 13
top cover 2
top cavity 21
strongly corrosive medium outlet 22
housing 3
receiving cavity 31
heat exchange medium inlet 32
heat exchange medium outlet 33
supporting plate 34
manhole 35
insulation layer 36
shock proof plate 37
upper tube plate 4
drainage groove 41
lower tube plate 5
heat exchange tube 6
gas-liquid separator 61
rotating piece 62
fastening device 63
down tube 7
sealing member 8
buffer ring 9

DETAILED DESCRIPTION OF THE PREFERRED EMBODIMENT

The following examples further illustrate the present invention, but the present invention is not limited thereto.

Please understand in combination with FIG. 1-FIG. 4, this present embodiment provides a heat exchanger, comprising: a liquid-collecting chamber 1, a top cover 2, a housing 3, an upper tube plate 4, a lower tube plate 5, a heat an exchange tube 6 and a down tube 7.

The heat exchanger is mainly used for heat exchange of strongly corrosive medium under a high temperature. Outer surfaces and surfaces of tube holes of the upper tube plate 4 and the lower tube plate 5, inner surfaces of the top cover 2 and the liquid-collecting chamber 1 are covered with a corrosion resistant layer. In the embodiment, the corrosion resistant layer is made of fluoropolymer, preferably PTFE. The corrosion resistant layer is used to prevent strongly corrosive medium under a high temperature from damaging the outer surfaces of the upper tube plate 4 and the lower tube plate 5, the inner wall surfaces of the top cover 2 and the liquid-collecting chamber 1.

The liquid-collecting chamber 1 is provided with a liquid-collecting cavity 11 and a strongly corrosive medium inlet 12. A condensate outlet 13 is further provided at one end of the liquid-collecting chamber 1 which is away from housing 3. The condensate formed during the cooling of the strongly corrosive medium under a high temperature is discharged from the condensate outlet 13 to the downstream equipment. In other embodiments, a corrosion-resistant and temperature-resistant layer may be built on the inner wall surface of the liquid-collecting chamber 1, and the corrosion-resistant and temperature-resistant layer is ceramic tile.

The top cover 2 is provided with a top cavity 21 and a strongly corrosive medium outlet 22.

The housing 3 is detachably connected between the liquid-collecting chamber 1 and the top cover 2, and the housing 3 is provided with a receiving cavity 31, neither the liquid-collecting cavity 11 nor the top cover 2 is in communication with the receiving cavity 31, a heat exchange medium inlet 32 and a heat exchange medium outlet 33 are spaced apart on a sidewall of the housing 3. The inner wall of the housing 3 is covered with an insulation layer 36.

The upper tube plate 4 is connected to one end of the housing 3, and is located between the housing 3 and the top cover 2, and the upper tube plate 4 partitions the receiving cavity 31 from the top cavity 21.

The lower tube plate 5 is connected to another end of the housing 3, and is located between the housing 3 and the liquid-collecting chamber 1, and the lower tube plate 5 partitions the receiving cavity 31 from the liquid-collecting chamber 11.

The heat exchange tube 6 sequentially passes through the top cavity 21, the upper tube plate 5, the receiving cavity 31, the lower tube plate 4 and the liquid-collecting cavity 11, two ends of the heat exchange tube 6 are in communication with the liquid-collecting cavity 11 and the top cavity 21 respectively. Through the glass heat exchange tube 6, the strongly corrosive medium under a high temperature exchanges heat with the heat exchange medium in the receiving cavity 31.

Sealing members 8 are clamped between an outer circumference of the heat exchange tube 6 and the upper tube plate 4 and between the outer circumference of the heat exchange tube 6 and the lower tube plate 5. Sealing members 8 are "H" shaped labyrinth sealing members.

The heat exchange tube 6 is made of a non-metallic material. The length of the heat exchange tube 6 is 6000 mm-9000 mm. In the present embodiment, the material of the heat exchange tube 6 is preferably quartz glass, and the length of the heat exchange tube 6 is preferably 7000 mm.

Figure 2:
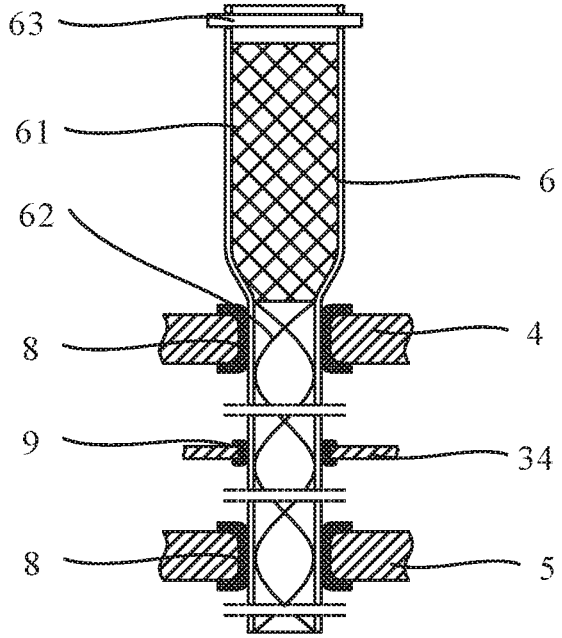
FIG. 2 is a structure schematic view of a heat exchange tube of a heat exchanger according to a preferred embodiment of the present invention.
Figure 3:
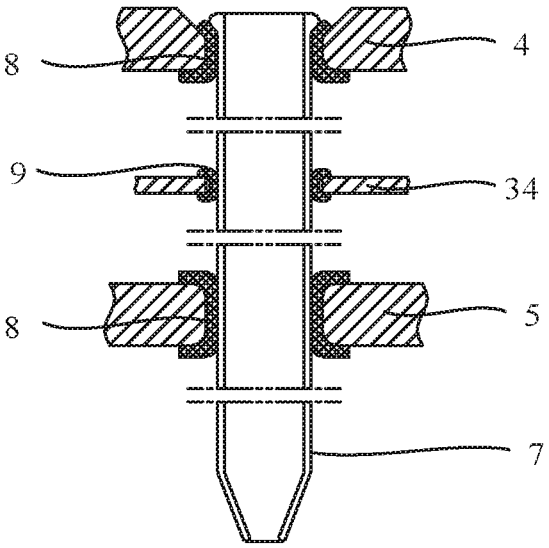
FIG. 3 is a structure schematic view of a down tube of a heat exchanger according to a preferred embodiment of the present invention.
Figure 4:
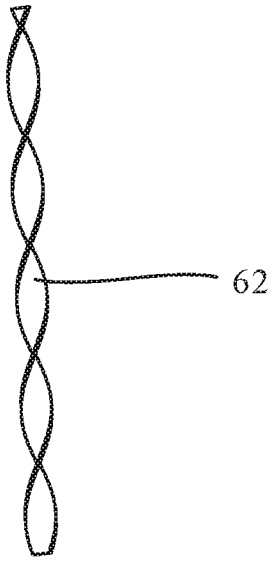
FIG. 4 is a structure schematic view of a rotating piece of a heat exchanger according to a preferred embodiment of the present invention.

A gas-liquid separator 61 is set at the end of the heat exchange tube 6 which is more distant from the liquid-collecting cavity 11. The gas-liquid separator is located within the heat exchange tube 6. The heat exchange tube 6 comprises an upper cylindrical tube, a conical tube and a lower cylindrical tube which are sequentially connected, and the inner diameter of the upper cylindrical tube is larger than that of the lower cylindrical tube. The inner diameter of a structure of one end of the heat exchange tube which is provided with the gas-liquid separator 61 (In FIG. 2 is the upper end of the heat exchange tube 6) is bigger. Specifically, the gas-liquid separator 61 is within the upper cylindrical tube and the conical tube. A plurality of circular holes are spaced apart between the top end of the heat exchange tube 6 and the gas-liquid separator 61 along a radial direction of the heat exchange tube 6, a fastening device 63 is provided within the circular hole, the fastening device 63 can be a fastening rod structure or a cable fastening structure, the fastening device 63 is for fixing the gas-liquid separator 61 within the heat exchange tube 6. The gas-liquid separator 61 is in the form of a mesh, the fastening device 63 limits movement of the gas-liquid separator 61.

A rotating piece 62 is provided within the heat exchange tube 6. Specifically, the rotating piece 62 is embedded in the heat exchange tube 6, and is made of a flexible material, in the present embodiment, the rotating piece 62 is made of glass. The flow deflector 62 is of one or several spiral structures, the thickness of the rotating piece 62 is 2-5 mm, the pitch is 50-100 mm, and the screw diameter is 32-34.5 mm By means of providing the rotating piece 62 within the heat exchange tube 6, the strongly corrosive medium passes through the inner cavity of the heat exchange tube 6 from bottom to upward, having constant contact with the rotating piece 62 and forming a swirl while passing through the rotating piece 62, so that heat exchange efficiency is enhanced and condensate can be directed into the liquid-collecting cavity. The rotating piece 62 effectively enhances heat transfer effect. In the present embodiment, the rotating piece 62 is preferably a spiral structure, the thickness of 62 is 2 mm, the pitch is 80 mm, and the screw diameter is 33 mm.

One end of the down tube 7 abuts against the upper tube plate 4, the other end of the down tube 7 passes through the lower tube plate 5, sealing members 8 are clamped between the outer circumference of the down tube 7 and the upper tube plate 4 and between the outer circumference of the down tube 7 and the lower tube plate 5, and two ends of the down tube 7 are in communication with the top cavity 21 and the liquid-collecting cavity 11, respectively. In the present embodiment, the down tube 7 is made of quartz glass.

The heat exchanger further comprises a supporting plate 34, the supporting plate 34 is located within the receiving cavity 31, and a part of the outer circumference of the supporting plate 34 abuts against the inner wall of the housing 3, a gap is formed between the other part of the outer circumference of the supporting plate 34 and the inner wall of the housing 3, and both the heat exchange tube 6 and the down tube 7 are disposed to pass through the supporting plate 34. The gap is in communication with the heat exchange medium inlet 32 and heat exchange medium outlet 33. When the number of the supporting plate 34 is plural, the supporting plates 34 are staggered and spaced apart, and a plurality of supporting plates 34 and the upper tube plate 4, the lower tube plate 5 and the receiving cavity 31 of the housing 3 constitute a "Z" shaped heat exchange medium passage. The supporting plate 34 has a function of supporting the heat exchange tube 6 and the down tube 7, and preventing excessive vibration of the heat exchange tube 6 and the down tube 7, especially when the heat exchange tube 6 and the down tube 7 are made of quartz glass, the supporting plate 34 plays a good role of supporting and protection; meanwhile, the supporting plate 34 and the upper tube plate 4, the lower tube plate 5 and the receiving cavity 31 of the housing 3 constitute a "Z" shaped heat exchange medium passage, which benefits better heat exchange between the strongly corrosive medium under a high temperature and the heat exchange medium.

Buffer rings 9 are clamped between the outer circumference of the heat exchange tube 6 and the supporting plate 34 and between the outer circumference of the down tube 7 and the supporting plate 34. The buffer rings 9 are made of rubber. The buffer rings 9 have a function of buffering and protecting the heat exchange tube 6 and the down tube 7. Meanwhile, in the present embodiment, the buffer rings 9 are preferably made of high temperature resistant rubber.

A drainage groove 41 is provided on one side of the upper tube plate 4 facing the top cavity 21, and the drainage groove 41 is in communication with the down tube 7. The shape of the drainage groove 41 is concave arc. The drainage groove 41 is provided with a drainage hole at the bottom end, the sealing members 8 are clipped between the outer circumference of one end of the down tube 7 and the inner wall surface of the drainage hole. Sealing members 8 are "H" shaped labyrinth sealing members.

Manholes 35 are spaced apart on the sidewall of the housing 3, the manholes 35 are used to observe and maintain the receiving cavity 31. The manholes 35 achieves the function of conveniently installing or maintaining the glass heat exchange tube 66 *r*. Manhole covers are provided at the manholes 35 to form a sealed receiving cavity 31. The manhole covers can be made as sight glass for easy observation of internal operation.

Within the receiving cavity 31, a shock-proof plate 37 is set near the heat exchange medium inlet 32, and the shock-proof plate 37 is to prevent the glass tube from being excessively impacted by heat exchange medium at the heat exchange medium inlet 32. The shock-proof plate 37 can be a multi-hole plate structure or a plurality of vertical plates structure, etc.

The working principle of the present embodiment is as follows: the heat exchange medium enters from the heat exchange medium inlet 32, passing through a "Z" shaped heat exchange medium passage, and is discharged from the heat exchange medium outlet 33; the strongly corrosive medium under a high temperature enters into the liquid-collecting cavity 11 of the liquid-collecting chamber 1 from the strongly corrosive medium inlet 12, passing through the heat exchange tube 6, and the strongly corrosive medium under a high temperature passes through the inner cavity of the heat exchange tube 6 bottom-up, since the rotating piece 62 is of a spiral piece structure, the strongly corrosive medium under a high temperature within the heat exchange tube 6 continuously impacts the rotating piece 62 and forms a swirling flow when passing through the flow deflector 62, thus the heat transfer efficiency is enhanced, when a phase change happens, the condensate flows into the liquid-collecting chamber 1 along the wall of the heat exchange tube 6 or the rotating piece 62, after condensation, the strongly corrosive medium under a high temperature continues to ascend through the gas-liquid separator 61 in the heat exchange tube 6, after being further filtered and captured, large-diameter droplets filtered by the gas-liquid separator 61 concentrate to liquid on the a surface of the upper tube plate 4 facing the top cavity 21, and flows to the liquid-collecting chamber 1 through the down tube 7. After exchanging heat and filtration, the remaining strongly corrosive medium under a high temperature is discharged to a downstream equipment through the strongly corrosive medium outlet 22 on the top cover 2.

Operation temperature of the heat exchanger in the present embodiment is −120° C.-280° C., operation pressure is no more than 0.3 Mpa, and total heat transfer coefficient is up to 165 KJ/m$^{2}$° C.

It should be understood by a technical skilled in the art that the foregoing description of the preferred embodiment is intended to be purely illustrative of the principles of the invention, rather than exhaustive thereof, and that changes and variations will be apparent to those skilled in the art, and that the present invention is not intended to be limited other than expressly set forth in the following claims.

The claims defining the invention are as follows:

1. A heat exchanger, wherein, it comprises:

a liquid-collecting chamber, the liquid-collecting chamber is provided with a liquid-collecting cavity and a strongly corrosive medium inlet;

a top cover, the top cover is provided with a top cavity and a strongly corrosive medium outlet;

a housing, the housing is detachably connected between the liquid-collecting chamber and the top cover, and the housing is provided with a receiving cavity, neither the liquid-collecting cavity nor the top cavity are in communication with the receiving cavity, and a heat exchange medium inlet and a heat exchange medium outlet are spaced apart on a sidewall of the housing at intervals;

an upper tube plate, the upper tube plate is connected to one end of the housing, and is located between the housing and the top cover, and the upper tube plate partitions the receiving cavity from the top cavity;

a lower tube plate, the lower tube plate is connected to the other end of the housing, and is located between the housing and the liquid-collecting chamber, and the lower tube plate partitions the receiving cavity from the liquid-collecting chamber;

a heat exchange tube, the heat exchange tube sequentially passes through the top cavity, the upper tube plate, the receiving cavity, the lower tube plate and the liquid-collecting cavity, two ends of the heat exchange tube are in connection with the liquid-collecting cavity and the top cavity respectively, sealing members are clamped between an outer circumference of the heat exchange tube and the upper tube plate and between the outer circumference of the heat exchange tube and the lower tube plate.

2. The heat exchanger according to claim 1, wherein outer surfaces of the upper tube plate and the lower tube plate, inner wall surfaces of the top cover and the liquid-collecting chamber are covered with corrosion resistant layer, and material of the corrosion resistant layer is fluoropolymer.

3. The heat exchanger according to claim 1, wherein the heat exchanger is further provided with a down tube, one end of the down tube abuts against the upper tube plate, the other end of the down tube is disposed to pass through the lower tube plate, sealing members are clamped between an outer circumference of the down tube and the upper tube plate and between the outer circumference of the down tube and the lower tube plate, and two ends of the down tube are sealingly in communication with the top cavity and the liquid-collecting cavity respectively.

4. The heat exchanger according to claim 3, wherein the heat exchanger further comprises a supporting plate, the supporting plate is located in the receiving cavity, and a part of outer circumference of the supporting plate abuts against an inner wall of the housing, a gap is formed between the other part of the outer circumference of the supporting plate and the inner wall of the housing, and both the heat exchange tube and the down tube are disposed to pass through the supporting plate.

5. The heat exchanger according to claim 4, wherein buffer rings are clipped between the outer circumference of the heat exchange tube and the supporting plate and between the outer circumference of the down tube and the supporting plate, and materials of the buffer rings are rubber.

6. The heat exchanger according to claim 1, wherein a gas-liquid separator is set at one end of the heat exchange tube which is away from the liquid-collecting cavity; a rotating piece is disposed in the heat exchange tube.

7. The heat exchanger according to claim 3, wherein a drainage groove is provided on one side of the upper tube plate facing the top cavity, and the drainage groove connects with the down tube.

8. The heat exchanger according to claim 1, wherein a condensate outlet is further set at one end of the liquid-collecting chamber which is away from the housing.

9. The heat exchanger according to claim 1, wherein manholes are spaced apart on the sidewall of the housing, and the manholes are used to observe and maintain the receiving cavity.

10. The heat exchanger according to claim 1, wherein the inner wall of the housing is covered with an insulation layer.

* * * * *